US012759689B2

(12) United States Patent
Tuuliainen et al.

(10) Patent No.: US 12,759,689 B2
(45) Date of Patent: Oct. 13, 2026

(54) DRIVE UNIT FOR JOINT PROPULSION AND MOTION CONTROL OF A MARINE VESSEL

(71) Applicant: VOLVO PENTA CORPORATION, Gothenburg (SE)

(72) Inventors: Peter Tuuliainen, Köping (SE); Anders Bergkvist, Gothenburg (SE)

(73) Assignee: Volvo Penta Corporation, Gothenburg (SE)

( * ) Notice: Subject to any disclaimer, the term of this patent is extended or adjusted under 35 U.S.C. 154(b) by 347 days.

(21) Appl. No.: 18/409,146

(22) Filed: Jan. 10, 2024

(65) Prior Publication Data

US 2024/0246652 A1 Jul. 25, 2024

(30) Foreign Application Priority Data

Jan. 20, 2023 (EP) ..... 23152670

(51) Int. Cl.
*B63H 21/30* (2006.01)
*B63B 39/00* (2006.01)
(Continued)

(52) U.S. Cl.
CPC ..... *B63H 21/30* (2013.01); *B63B 39/00* (2013.01); *B63H 21/17* (2013.01); *B63H 21/213* (2013.01);
(Continued)

(58) Field of Classification Search
CPC ..... B63H 21/00; B63H 21/30; B63H 21/213; B63H 21/12; B63H 21/17; B63H 21/20; B63H 2021/202; B63H 23/00; B63H 23/12; B63H 23/34; B63H 23/02; B63H 23/06; B63H 5/00; B63H 5/08; B63H 5/125;
(Continued)

(56) References Cited

U.S. PATENT DOCUMENTS 447,056 A 2/1891 Hall
1,851,833 A 3/1932 Herbst
(Continued)

FOREIGN PATENT DOCUMENTS

CN 108100192 A 6/2018
CN 109050845 A 12/2018
(Continued)

OTHER PUBLICATIONS

Extended European Search Report in corresponding European Application No. 23152670.8 dated Jul. 14, 2023 (10 pages).
(Continued)

*Primary Examiner* — Daniel V Venne
(74) *Attorney, Agent, or Firm* — Jeffri A. Kaminski; Venable LLP

(57) ABSTRACT

A drive unit for propulsion and trim control of a marine vessel. The drive unit extends in use from the vessel along a vertical axis to a base plane normal to the vertical axis, and spanned by orthogonal longitudinal and lateral axes. The drive unit includes a first propulsion unit and a second propulsion unit arranged separated along the lateral axis and intersected by the base plane. The first propulsion unit and the second propulsion unit are jointly rotatable about the vertical axis, where the first propulsion unit and the second propulsion unit are individually rotatable about the lateral axis.

19 Claims, 7 Drawing Sheets

(51) Int. Cl.

| | |
|---|---|
| ***B63H 21/17*** | (2006.01) |
| ***B63H 21/21*** | (2006.01) |
| ***B63H 23/12*** | (2006.01) |
| ***B63H 23/34*** | (2006.01) |
| ***B63H 25/02*** | (2006.01) |
| ***B63H 25/42*** | (2006.01) |
| ***B63H 25/46*** | (2006.01) |

(52) U.S. Cl.
CPC ..... *B63H 23/12* (2013.01); *B63H 23/34* (2013.01); *B63H 25/02* (2013.01); *B63H 25/42* (2013.01); *B63H 25/46* (2013.01); *B63H 2025/026* (2013.01)

(58) Field of Classification Search
CPC ..... B63H 11/00; B63H 11/107; B63H 3/00; B63H 20/00; B63H 2020/003; B63H 25/00; B63H 25/02; B63H 25/42; B63H 25/46; B63H 2025/026; B63B 39/00; B63B 79/00; B63B 79/10; B63B 79/15
USPC ..... 440/1, 3, 4, 5, 6, 38, 40, 49, 53, 57, 60, 440/75, 83, 84, 86
See application file for complete search history.

(56) References Cited

U.S. PATENT DOCUMENTS

| | | | | |
|---|---|---|---|---|
| 2,936,730 | A | 5/1960 | Patty, Jr. | |
| 3,954,083 | A | 5/1976 | Frostrom | |
| 3,983,834 | A | 10/1976 | Hirmann | |
| 4,470,562 | A | 9/1984 | Hall et al. | |
| 7,240,630 | B2 | 7/2007 | Akers | |
| 11,548,605 | B2 * | 1/2023 | Husberg | B63H 5/125 |
| 2006/0057910 | A1 | 3/2006 | Stallings | |
| 2006/0172630 | A1 | 8/2006 | Kawamoto | |
| 2007/0046241 | A1 * | 3/2007 | Pettersson | B63H 5/125 318/588 |
| 2007/0275613 | A1 | 11/2007 | Vartdal | |
| 2010/0030411 | A1 | 2/2010 | Wilson et al. | |
| 2011/0153125 | A1 | 6/2011 | Arbuckle et al. | |
| 2014/0008489 | A1 | 1/2014 | Rosenlund | |
| 2018/0201343 | A1 | 7/2018 | Lagarrigue et al. | |
| 2020/0047849 | A1 | 2/2020 | Claughton et al. | |
| 2020/0398939 | A1 | 12/2020 | Gradolph | |
| 2021/0253198 | A1 | 8/2021 | Rosen | |
| 2021/0403155 | A1 | 12/2021 | Neiser | |
| 2021/0403156 | A1 | 12/2021 | Pul | |
| 2023/0286613 | A1 | 9/2023 | Tell et al. | |

FOREIGN PATENT DOCUMENTS

| | | | |
|---|---|---|---|
| CN | 115384743 | A | 11/2022 |
| DE | 2520292 | A1 | 11/1976 |
| DE | 102018109085 | A1 | 10/2019 |
| DE | 102018112052 | A1 | 11/2019 |
| EP | 2703279 | A1 | 3/2014 |
| EP | 3722201 | A1 | 10/2020 |
| EP | 4086154 | A2 | 11/2022 |
| JP | H0848288 | A | 2/1996 |
| KR | 20110100900 | A | 9/2011 |
| KR | 101411508 | B1 | 6/2014 |
| WO | 03064249 | A1 | 8/2003 |
| WO | 2017115714 | A1 | 7/2017 |

OTHER PUBLICATIONS

Extended European Search Report dated Apr. 3, 2025 in corresponding European Patent Application No. 24152793.6, 20 pages.
Final Office Action dated Dec. 29, 2025 in corresponding U.S. Appl. No. 18/416,047, 35 pages.
In re Fine, 837 F.2d 1071, 5 USPQ2d 1596 (Fed. Cir. 1988), In re Jones F.2d 347, 21 USPQ2d 1941 (Fed. Cir. 1992), and *KSR International Co.* v. *Teleflex, Inc.*, 550 U.S. 398, 82 USPQ2d 1385 (2007), 5 pages.
In re Keller, 642 F.2d 413,208 USPQ 871 (CCPA 1981); In re Merck & Co., 800 F.2d 1091, 231 USPQ 375 (Fed. Cir. 1986), 15 pages.
In re McLaughlin, 443 F.2d 1392, 170 USPQ 209 (CCPA 1971), 7 pages.
In re Ole K. Nilssen, 851 F.2d 1401 (Fed. Cir. 1988), 5 pages.
Non Final Office Action dated Apr. 23, 2026 in corresponding U.S. Appl. No. 18/416,047, 38 pages.

* cited by examiner

DRIVE UNIT FOR JOINT PROPULSION AND MOTION CONTROL OF A MARINE VESSEL

TECHNICAL FIELD

This disclosure relates generally to marine propulsion systems. Drive units and associated control systems are disclosed which provide integrated propulsion and motion control of a vessel, where the motion control may comprise any of; trim control, roll stabilization, or vessel position control. The drive units discussed herein are suitable for being powered by a combustion engine, by an electric machine, or by a hybrid driveline.

BACKGROUND

Modern marine propulsion systems normally comprise a main propulsor, such as a propeller arrangement or a water jet system, which provides forward thrust, and also one or more separate motion control systems, such as a trim system that controls a pitch angle of the hull relative to the horizontal plane, and a stabilizer system which mitigates roll and pitch motion by the vessel.

EP2703279A1 describes an example motion control system for a vessel which comprises interceptors designed to optimize motion behavior of a vessel moving through water, in particular a trim angle of the vessel.

U.S. Pat. No. 7,240,630 describes another motion control system comprising a gyro stabilizer system that can be used to mitigate roll motion by a vessel due to wind and waves.

Having separate systems for propulsion and motion control drives complexity and cost. There is a desire to provide simplified more efficient marine propulsion systems.

SUMMARY

Aspects of the present disclosure relate to a drive unit for both propulsion and motion control of a marine vessel, i.e., a drive unit which functions both as main propulsor and motion control system at the same time. The drive unit extends in use from the vessel downwards along a vertical axis of the drive unit to a base plane which is normal to the vertical axis. The base plane of the drive unit is spanned by longitudinal and lateral axes which are orthogonal to each other, where the longitudinal axis extends in the nominal direction of thrust and the lateral axis is transversal to the nominal direction of thrust. The drive unit comprises a first propulsion unit and a second propulsion unit arranged separated along the lateral axis and intersected by the base plane, i.e., the propulsion units are arranged side-by-side and lie in the base plane. The first propulsion unit and the second propulsion unit are jointly rotatable together with a main drive unit body about the vertical axis, which means that the azimuth angle of drive unit thrust is controllable by joint rotation of the first propulsion unit and the second propulsion unit. The first propulsion unit and the second propulsion unit are also individually rotatable about the lateral axis, i.e., the two propulsion units can be adjusted separately in elevation angle independently from each other, such that one propulsion unit has one elevation angle relative to the base plane, and the other propulsion unit has another elevation angle relative to the base plane.

Aspects of the disclosure may seek to provide a more efficient and compact drive unit which provides both main propulsion for a vessel and at the same time allows for advanced motion control of the vessel, such as trim control, dynamic roll stabilization, and dynamic pitch motion control. The ability of the drive unit body to rotate freely about its vertical axis in combination with the ability of the two propulsion units to rotate freely about the lateral axis provides a control freedom in several dimensions that can be used to generate thrust in different directions and also roll and pitch motion by the vessel.

The drive unit comprises some form of hull mount interface which may be intersected by the vertical axis. The hull mount interface connects the drive unit to the vessel. Various hull mount interfaces are possible, such as an interface mounted at the underside of the hull, or at the transom of the vessel similar to an outboard engine mounting interface.

The first propulsion unit and the second propulsion unit are preferably arranged such that they are jointly rotatable about the vertical axis over at least 360 degrees, i.e., full circle. This means that the direction of thrust can be directed anywhere over the full circle, such that the drive unit can generate forward thrust, lateral thrust, and reverse thrust by turning the drive unit body about the vertical axis to configure different azimuth angles of thrust. There is no need for a gearbox inbetween engine and drive unit since the drive unit can be rotated 180 degrees to provide reverse thrust during a hard braking maneuver.

The first propulsion unit and the second propulsion unit may also be individually rotatable about the lateral axis over at least 270 degrees. This means that the propulsion units can be configured to face in opposite directions, generating a turning force about the vertical axis. A rotation of more than 360 degrees may also be implemented, such as a full circle rotation. A smaller rotation span can also be used, i.e., on the order of +/−30 degrees or so.

The ability of the drive unit body to rotate freely around the vertical axis and the ability of the propulsion units to rotate separately around the lateral axis provides great flexibility when it comes to generating different propulsion forces and moments by the drive unit. As will be explained in more detail below, the drive unit can be used to provide a main propulsion force that drives the vessel through the water, and at the same time perform motion control of the vessel, i.e., trim control, roll stabilization and control of the pitch motion by the vessel as it moves through the water, by adjusting azimuth angle and elevation angles of the drive units in a dynamic manner.

The first and the second propulsion units optionally comprise respective oblate foiling plane members, i.e., wing-like planar portions that are fixedly connected to the propulsion unit and separately rotatable about the lateral axis together with the propulsion unit. A rotation of a propulsion unit about the lateral axis determines an angle between the oblate foiling plane member of the propulsion unit and the base plane of the drive unit and therefore also the lifting force or counter-lifting force generated by the foiling member. The foiling plane members can be used to generate lift, counter-lift, roll motion by the hull, and also pitch motion by the hull, which is an advantage.

Each propulsion unit optionally comprises an electric or hydraulic elevation motor connected to a rack and pinion arrangement arranged to control a rotation of the propulsion unit (and optional foiling plane member) about the lateral axis. The rack and pinion arrangement may be replaced by a ring gear and pinion arrangement if the propulsion unit is arranged to rotate more freely about the lateral axis, i.e., over a larger angular span.

The drive unit optionally comprises a main exhaust channel extending from an input aperture formed in the hull interface of the drive unit to a branching point intersected by the base plane. First and second exhaust channel branches extend from the branching point to output apertures formed in the first propulsion unit and in the second propulsion unit, respectively. This way exhaust from, e.g., an internal combustion engine can be guided down into the drive unit and released under the water surface which is an advantage since then the exhaust is barely noticeable to persons onboard the vessel.

The drive unit optionally comprises a vertical drive shaft extending along the vertical axis down to a central bevel gear. First and second lateral drive shafts extend out from the central bevel gear along the lateral axis to the first and second propulsion units, where respective outer bevel gear arrangements connect the lateral drive shafts to propeller axles of the first and second propulsion units. Thus, a central power source can be used to power both propulsion units in an efficient manner. The rotation by the drive unit body about the vertical axis and the separate rotations of the propulsion units about the lateral axis is not hindered by this transmission arrangement, which is an arrangement.

The first and the second propulsion units optionally comprise submerged electric propulsion machines, sometimes referred to as pod drives, arranged to power respective propulsors of the propulsion units. In this case it is sufficient if an electrical harness extends down into the drive unit, e.g., from a connector formed in the hull mount interface of the drive unit. The pod drive solution may be combined with the solution involving the drive shaft and the bevel gears.

Each electric propulsion machine of the above-mentioned pod-drive solution is optionally formed around a hollow stator, where a water channel is formed through the hollow stator in direction of the longitudinal axis. This way an efficient cooling can be achieved, in combination with a reduction in water resistance. The first and the second propulsion units may also comprise two electric propulsion machines each, separated along the longitudinal axis, where each electric propulsion machine is arranged to power a respective propeller.

In some examples, the drive unit also comprises a control unit arranged to obtain a current motion of the vessel, e.g., from one or more sensor systems onboard the vessel, and also a desired motion of the vessel. The control unit can then be arranged to adjust the rotation of the drive unit about the vertical axis and/or the rotations of the propulsion units about the lateral axis to reduce a difference between the current motion of the vessel and the desired motion of the vessel. This way the control unit can be configured to control the different degrees of freedom of the drive unit to achieve a desired motion behavior of the vessel as it moves through the water. Several examples of motion behavior control by the control unit will be given in the following.

According to an example, the current and desired motion of the vessel comprise motion by the vessel relative to ground, and the desired motion corresponds to stationarity by the vessel, i.e., an operating condition where the vessel is held in position relative to a location on the ground. The control unit is then arranged to adjust at least the rotation of the drive unit body about the vertical axis to keep the vessel stationary relative to ground. This application is often referred to as assisted docking, or virtual anchoring. It is an advantage that the drive unit is able to perform this function without additional motion control systems on the vessel.

According to another example, the current and desired motion of the vessel comprise roll angle and/or roll motion of the vessel, and the control unit is arranged to adjust the respective rotations of the propulsion units about the lateral axis to set a desired roll angle by the vessel and/or to reduce a roll motion by the vessel. This way the control unit uses the different control degrees of freedom of the propulsion units to mitigate roll motion as the vessel moves through water.

According to yet another example, the current and desired motion of the vessel comprise pitch angle and/or pitch motion by the vessel, and the control unit is arranged to adjust the respective rotations of the propulsion units about the lateral axis to set a desired pitch angle by the vessel and/or to reduce a pitch motion of the vessel. Thus, the drive unit is used for trim control of the vessel, without any additional trim support actuator system.

The above aspects, accompanying claims, and/or examples disclosed herein above and later below may be suitably combined with each other as would be apparent to anyone of ordinary skill in the art.

Additional features and advantages are disclosed in the following description, claims, and drawings, and in part will be readily apparent therefrom to those skilled in the art or recognized by practicing the disclosure as described herein. There are also disclosed herein control units, computer systems, computer readable media, and computer program products associated with the above discussed technical benefits.

BRIEF DESCRIPTION OF THE DRAWINGS

With reference to the appended drawings, below follows a more detailed description of aspects of the disclosure cited as examples.

DETAILED DESCRIPTION

Figure 1:
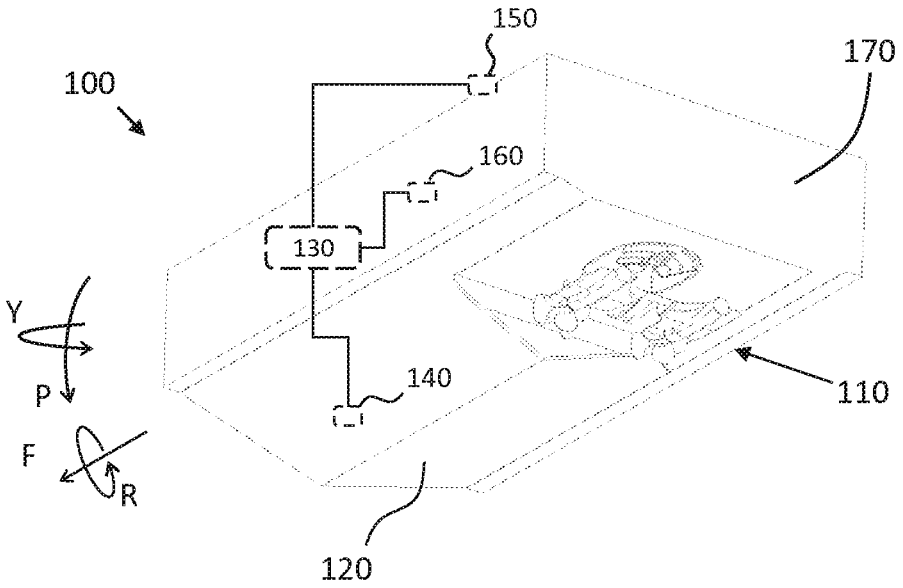
FIG. 1 illustrates an example marine vessel comprising a drive unit.

The present disclosure will now be described more fully hereinafter with reference to the accompanying drawings, in which exemplary embodiments are shown. The disclosure may however, be embodied in many different forms and should not be construed as limited to the embodiments set forth herein; rather, these embodiments are provided for thoroughness and completeness. Like reference character refer to like elements throughout the description. Aspects set forth below represent the necessary information to enable those skilled in the art to practice the disclosure.

Reference will be made herein to vertical, longitudinal and lateral axes of various drive units. It is appreciated that these axes are not necessarily aligned with vertical and horizontal axes of an earth or global coordinate system. Rather, the vertical direction is to be interpreted loosely as a direction extending from the vessel towards sea bottom along an extension direction of a drive unit body, while the longitudinal and lateral directions are to be interpreted loosely as a forward-reverse direction of a drive unit body and a direction transversal to the forward-reverse direction, respectively.

FIG. 1 illustrates a marine vessel 100, in this case a marine leisure craft. The present disclosure is, however, not limited to the type of vessel illustrated in FIG. 1, but can be used also in, e.g., smaller commercial vessels such as ferries, in smaller work boats, and also in sail boats and dinghies.

The vessel 100 generally comprises a drive unit 110 attached to a hull 120 of the vessel. FIG. 1 illustrates a drive unit 110 suitable for use with an inboard power source, such as a combustion engine, an inboard electric machine, or a hybrid driveline comprising both a combustion engine and an electric machine. The drive units discussed herein can, however, also be used as outboard drive units mounted at the vessel transom 170.

More than one drive unit 110 can be used on a single hull 120, and more than one engine can be used to power a single drive unit 110. Thus, a vessel 100 can comprise any number of drive units 110, and a drive unit 110 may comprise any number of engines used to power it.

The vessel 100 moves in a forward direction F, and normally exhibits both roll motion R and pitch motion P, as well as yaw motion Y, where the yaw motion may be due at least in part to steering of the vessel 100.

The trim angle of the vessel 100 may be defined as the average angle over a time period between the forward direction of the vessel F and the earth horizontal plane. Trim angle is, essentially, the average pitch angle P of the vessel in use. Various trim systems are known which can be used to adjust the time angle of the vessel 100. Most trim systems operate by adjusting a relationship between the thrust angle of the main propulsor relative to the hull of the vessel. A hydraulic linear actuator can, e.g., be arranged to adjust a thrust angle of an outboard motor to control vessel trim. Interceptor arrangements, such as disclosed in EP2703279A1, are also known which can be used to adjust vessel trim.

A control unit 130 onboard the vessel 100 may be configured to obtain information from one or more sensor systems to determine a current motion of the vessel, e.g., relative to ground or relative to the water. A speed log 140 can be used to determine a speed through water (STW) of the hull 120. A satellite navigation system 150, such as a global positioning system (GPS) receiver, can be used to determine motion by the vessel relative to ground. An inertial measurement unit (IMU) 160 can be used to determine accelerations of the hull 120 in three dimensions (e.g., longitudinal, lateral and vertical acceleration), as well as pitch motion, roll motion and yaw motion by the hull 120. These sensor technologies are well known and will therefore not be discussed in more detail herein.

A desired motion by the vessel 100 may be preconfigured by the control unit 130 or received as an input signal from an operator of the vessel 100. The operator may e.g., wish to adjust a trim angle of the vessel in addition to setting a desired STW and yaw motion by the vessel. An operator may also wish to active stabilization systems in order to reduce, e.g., roll motion by the hull 120. Autonomous systems may also be used to maneuver a marine vessel. These systems then output signals indicative of the desired motion by the vessel.

A difference between the current motion of the vessel 100 and the desired motion by the vessel 100 may be determined by the control unit 130 based on the input signals from the one or more sensor systems 140, 150, 160. The control unit 130 may then control the different motion control systems on the vessel 100 to reduce this difference. Traditionally, the control unit 130 controls several separate systems to obtain the desired motion by the vessel, such as a main propulsion system, steering, trim control, as well as roll motion mitigation and other stabilization systems.

Virtual anchor systems and assisted docking systems are electronic control systems which utilize the drive units of a marine vessel to keep the vessel stationary, despite effects from wind a sea current. A virtual anchoring system is often capable of maintaining a fixed position of the vessel 100 relative to ground for extensive periods of time by monitoring current motion by the vessel and compensating for this motion to maintain stationarity of the vessel, just as if the vessel has been anchored to sea bottom.

It is an objective of the present disclosure to describe drive units which integrate a main propulsion system and vessel motion control functionality into the same drive unit. The drive units discussed herein can be used to perform advanced motion control of a marine vessel, such as roll and pitch motion control, as well as virtual anchoring and assisted docking functionality, and at the same time provides an efficient main propulsion system.

Figure 2:
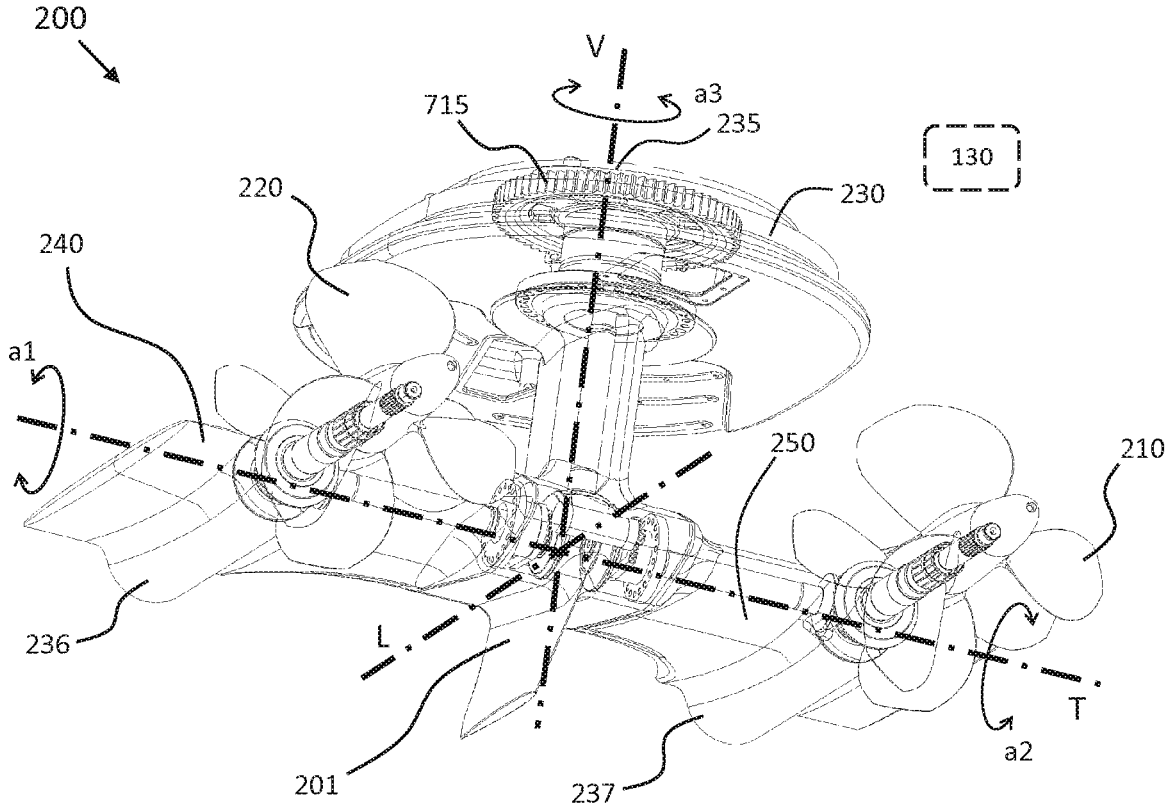
FIGS. 2-3 show example drive units according to the present teaching.
Figure 3:
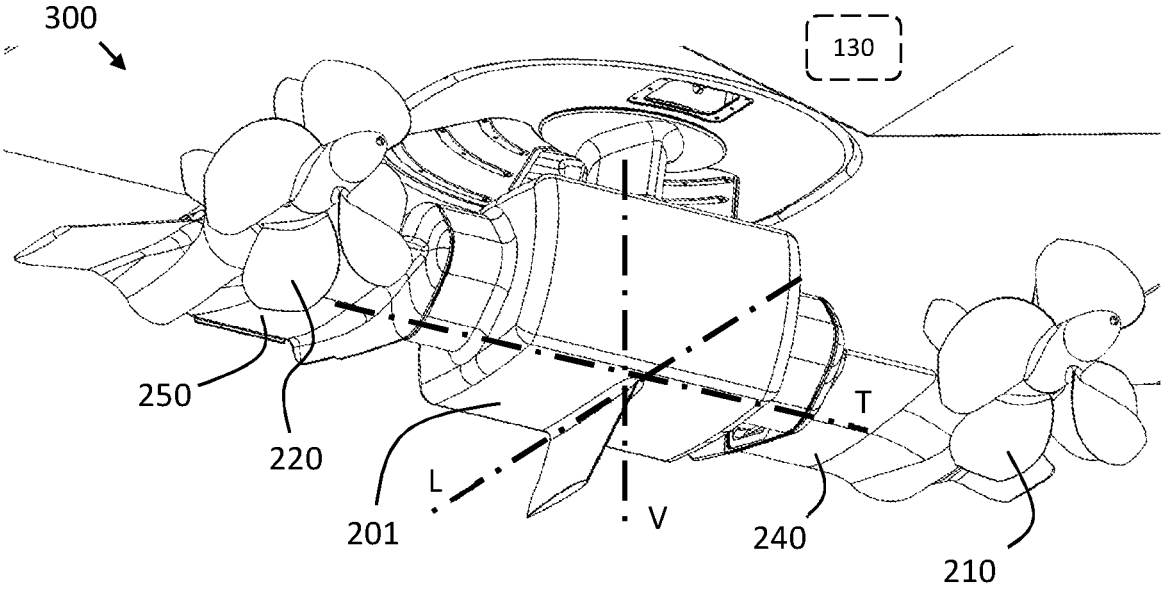

FIGS. 2 and 3 illustrate example drive units 200, 300 for joint propulsion and trim control of a marine vessel 100 according to the present teaching. The drive units 200, 300 extend from the vessel hull (normally the bottom of the hull or the transom part of the hull) along a vertical axis V to a base plane (not shown in FIG. 3) which is normal to the vertical axis V. The base plane is spanned by orthogonal longitudinal and lateral axes L, T, as illustrated in FIG. 2. The longitudinal axis L extends generally in a forward thrust direction of the drive unit, while the lateral axis T extends laterally with respect to the longitudinal axis. The drive unit 110, 200, 300 comprises a first propulsion unit 210 and a second propulsion unit 220 arranged separated along the lateral axis T and intersected by the base plane, i.e., there are two propulsion units attached to the drive unit which are arranged side-by-side. The first and second propulsion units 210, 220 may e.g., comprise respective single propeller propulsors, dual (counter-rotating) propeller propulsors, or waterjet propulsors. The drive units discussed herein are not limited to any particular form of propulsor, rather any type of combination of propulsors can be used without limitation. The first and second propulsion units 210, 220 extend laterally out from a drive unit body 201 which is rotatable about the vertical axis V. Thus, the first and second propulsion units 210, 220 are both rotated in azimuth angle when the drive unit body 201 is rotated about the vertical axis V. In other words, the first propulsion unit 210 and the second propulsion unit 220 are jointly rotatable a3 about the vertical axis V, which means that the azimuth angle of generated thrust provided by the drive unit can be controlled freely. In other words, the drive unit 110, 200, 300 is preferably arranged to rotate full circle about the vertical axis V, i.e., by 360 degrees or more. By adjusting the azimuth angle a3 of the drive unit, the vessel 100 can be made to turn and the drive unit can also be configured to generate reverse thrust. Thus, the main power source does not need a gear box to place the drive unit into reverse, since the first and second propulsion units can be rotated 180 degrees instead.

Figure 11A:
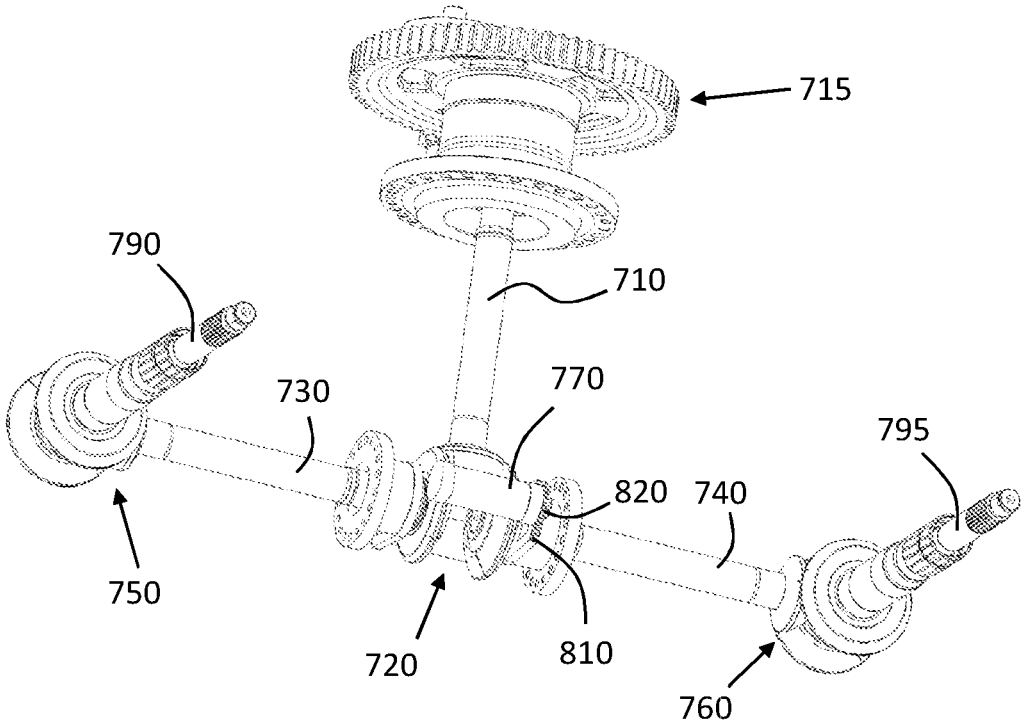
FIGS. 11A-C show details of an example drive unit.
Figure 11B:
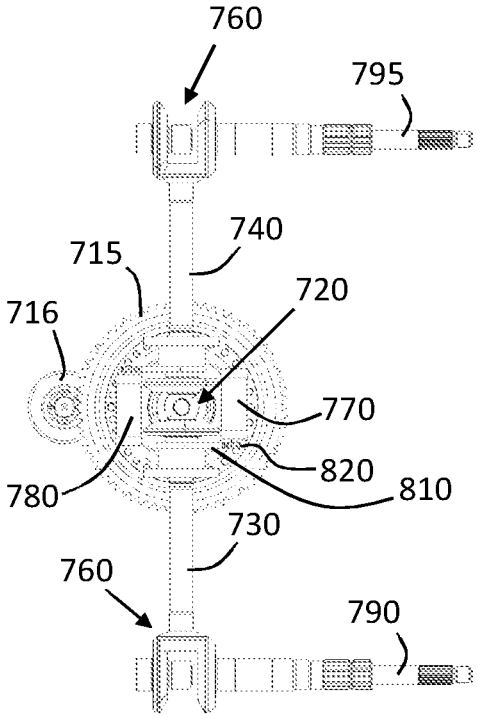
Figure 11C:
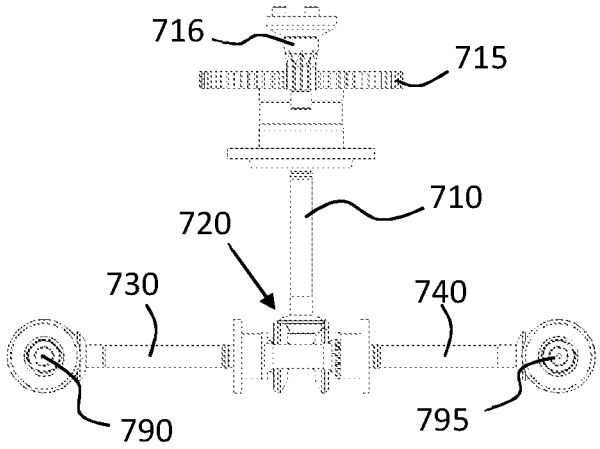

The first propulsion unit 210 and the second propulsion unit 220 are also individually rotatable a1, a2 about the lateral axis T. This means that the angle of the first propulsion unit with respect to the plane, and the angle of the second propulsion unit with respect to the plane can be configured independently of each other. Both propulsion units may be configured to provide thrust in the same general direction or in opposite directions in order to generate a moment about the vertical axis V. By configuring different elevation angles of the first and second propulsion units, a roll motion force acting on the vessel can also be induced, e.g., to counter a roll motion caused by sea and wind. This functionality will be discussed in more detail below. A hull mount interface 230 is intersected by the vertical axis V in FIGS. 2 and 3. This type of hull mount interface is suitable for use in inboard installations where the main power source is located inboard. In this case the drive unit extends down into the water from a location under the boat, as illustrated in FIG. 1. The drive units discussed herein can also be used in outboard configurations, where they are instead mounted on the transom of the boat. It is also possible to use the drive units to carry submerged electric machines, as will be discussed in the following. The hull mount may e.g., rotatably support a circular gear train 715 which engages with a pinion of a rotation actuator 716, exemplified in, e.g., FIG. 11B. The rotation actuator can then be used to rotate the drive unit about the vertical axis V to configure different azimuth angles a3 of the drive unit.

Figure 4A:
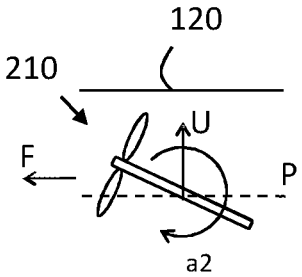
FIGS. 4A-C illustrate joint propulsion and trim control using a drive unit.
Figure 4B:
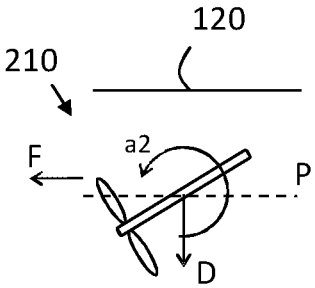
Figure 4C:
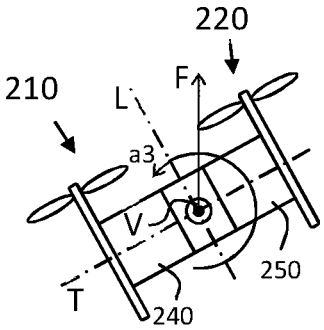

FIGS. 4A-C illustrate some motion control possibilities of the drive unit 200, 300. The example propulsion unit 210 is here a pulling single propeller. Both single and dual propeller propulsion units are conceivable. Pushing propeller arrangements are of course also possible, as well as water jet arrangements. The water jet arrangements can be reversible thrust or fixed thrust arrangements.

In FIG. 4A, the example propulsion unit 210 has been rotated such that the propulsor faces upwards towards the bottom of the hull 120, i.e., the elevation angle of the propulsion unit relative to the base plane has been changed by a positive amount. This generates a lifting upwards force U by the propulsion unit since it is a pulling propulsor.

In FIG. 4B the example propulsion unit 210 has instead been rotated to face away from the hull, which in this case generates a downward force or a counter-lift force D acting on the propulsion unit 210 because of the pulling propulsor.

Depending on how the two propulsion units 210, 220 are rotated about the lateral axis T relative to each other and relative to the base plane, various motion control effects can be obtained, as will now be explained.

Assuming a pulling system; if both the first propulsion unit 210 and the second propulsion unit 220 are rotated upwards as in FIG. 4A, then the drive unit 110 will generate an upwards lifting force. If the drive unit is located at the stern of the vessel 100, then this lifting force will cause the trim angle of the vessel to be reduced, i.e., the pitch angle will become smaller due to the lifting force generated at the rear part of the vessel. This lifting force can be generated regardless of whether the hull 120 is doing any speed through the water or not. I.e., the lifting force can be generated during forward motion, during reverse motion, or in a standstill scenario where the hull is stationary.

Assuming a pulling system; if both the first propulsion unit 210 and the second propulsion unit 220 are instead rotated downwards as in FIG. 4B, then a downward force, or counter-lifting force, will be generated. This downward force will also have an effect on the trim angle of the vessel 100. Thus, it is appreciated that the control unit 130 can use the drive unit 200, 300 to control trim of the vessel by rotating the propulsion units 210, 220 about the lateral axis T.

If the first and the second propulsion units are instead rotated in opposite directions about the lateral axis T (configured at different elevation angles), relative to the base plane, then a roll motion R by the vessel 100 will be obtained. This is because a downward force will be generated on one side of the drive unit 110 and an upwards force will be generated on the other side of the drive unit 110, together generating a rotation force by the drive unit about the longitudinal axis L.

FIG. 4C illustrates rotation by the first and second propulsion units 210, 220 about the vertical axis V. This operation changes the azimuth angle of the generated thrust, which will generate yaw motion by the vessel, i.e., steering. Certain angles of the drive unit about the vertical axis V may also generate a lateral motion by the hull 120 through the water, which may come in handy during, e.g., mooring operations and the like.

It is appreciated that the drive units 110, 200, 300 discussed herein allow independent control of the elevation angles a1, a2 of the first and second side-by-side propulsion units 210, 220, and at the same time a joint control of azimuth angle a3 of the propulsion units 210, 220. The elevation angle control (rotation about the lateral axis T) may be performed full circle, or at least for 180 degrees or more about the lateral axis T, which means that the propulsion units can also be configured to face in opposite directions relative to the longitudinal axis L of the drive unit.

All control options taken together, it is understood that the drive units disclosed herein are exceptionally versatile when it comes to generating thrust in different directions relative to the forward direction F of the vessel, and dynamically controlling motion by the vessel. By controlling the rotation of the drive unit about the vertical axle, and the rotations of the first and second propulsion units about the lateral axis T (including the direction of thrust), several different combinations of; forward thrust, reverse thrust, lateral thrust, yaw motion, pitch motion, and roll motion can be obtained.

According to some examples, the first and the second propulsion unit 210, 220 comprise respective oblate foiling plane members 240, 250, as illustrated in FIGS. 2 and 3. These oblate foiling plane members are wing-like portions, or foiling wings, which interact with the flow of water passing them to generate a lifting force, or a counter-lifting force as the drive unit makes speed through the water. The oblate foiling plane members strengthen the lifting and counter-lifting forces generated by the propulsion units 210, 220 as they are angled at different elevation angles a1, a2, i.e., as they are rotated separately about the lateral axis T with respect to the base plane. Thus, it is understood that a rotation of a propulsion unit 210, 220 about the lateral axis T determines an angle between the oblate foiling plane member 240, 250 of the propulsion unit 210, 220 and the base plane of the drive unit 110, 200, 300, to generate a lifting force or a counter-lifting force which has an effect on the motion of the vessel 100. The lifting force may e.g., influence the trim angle of the vessel, or generate a roll motion by the vessel. The oblate foiling plane members 240, 250 may also be used to operate the vessel 100 in foiling mode, where the hull 120 is lifted out of the water by the lifting force provided by the foiling-plane members.

Figure 5:
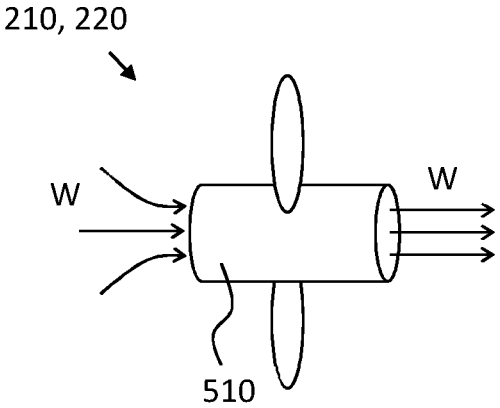
FIGS. 5-6 show example electric propulsion units for a drive unit.
Figure 6:
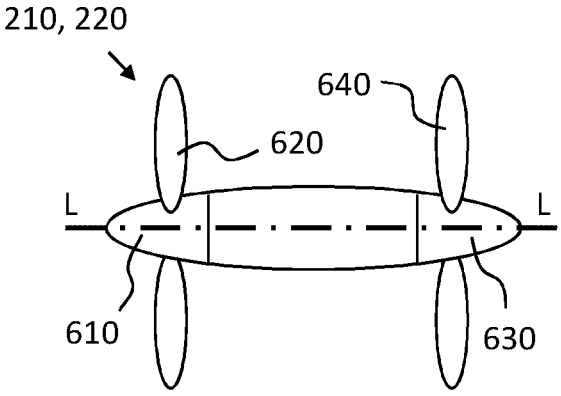

FIGS. 5 and 6 illustrate optional submerged electric machines which can be used with the drive units discussed herein. In other words, the first and the second propulsion units 210, 220 may comprise submerged electric propulsion machines 510, 610, 630 arranged to power respective propulsors of the propulsion units 210, 220. In this case an electric harness extends down from the vessel 100 into the drive unit 110, 200, 300, preferably in the general direction of the vertical axis V. The inverters used to generate the alternating current for powering the electric machines may be comprised in the drive unit, i.e., submerged under the water line, or supported in the hull of the vessel.

Each electric propulsion machine 510 is optionally formed around a hollow stator, where a water channel W is formed through the hollow stator in direction of the longitudinal axis L, as illustrated in FIG. 5. An example of this type of electric machine is illustrated in SE544730C2. The electric machines described in SE544730C2 may be used with advantage in the drive units disclosed herein.

The first and the second propulsion unit 210, 220 may also comprise two electric propulsion machines 610, 630, as illustrated in FIG. 6, where the electric propulsion machines 610, 630 are separated along the longitudinal axis L, and powers a respective propeller 620, 640.

Figure 7:
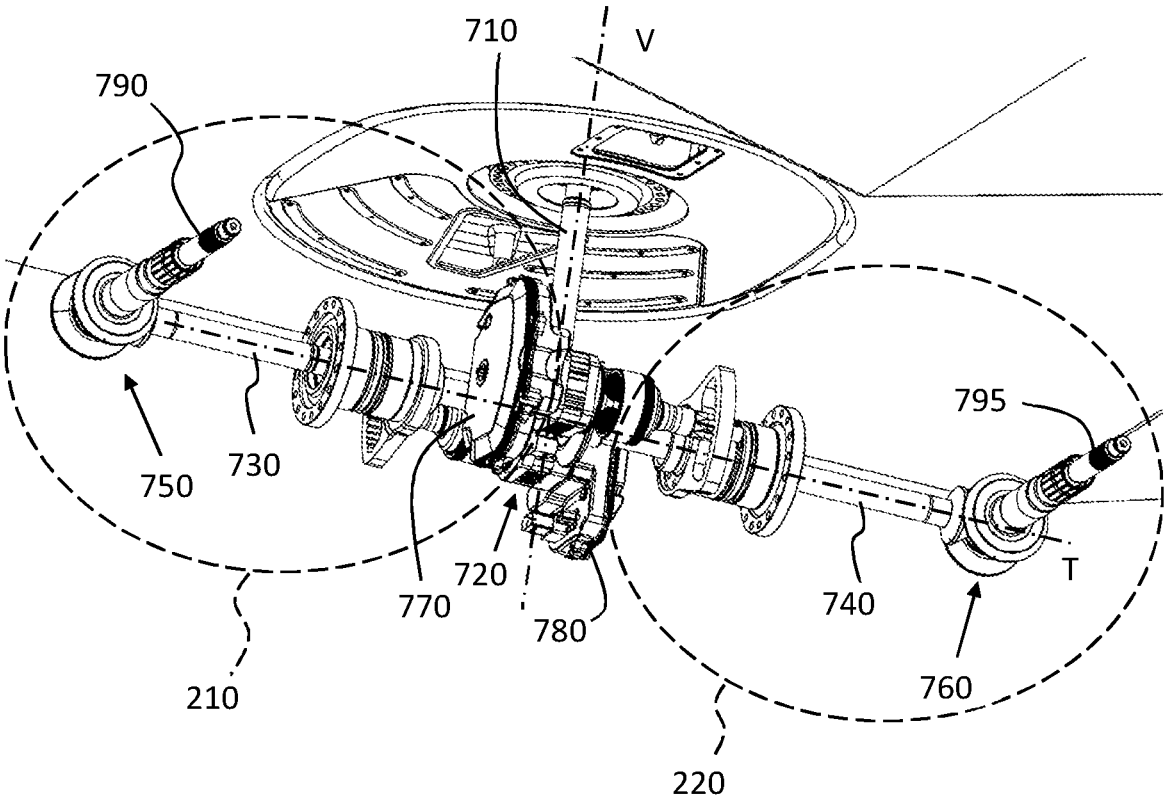
FIGS. 7-9 show details of an example drive unit.
Figure 8:
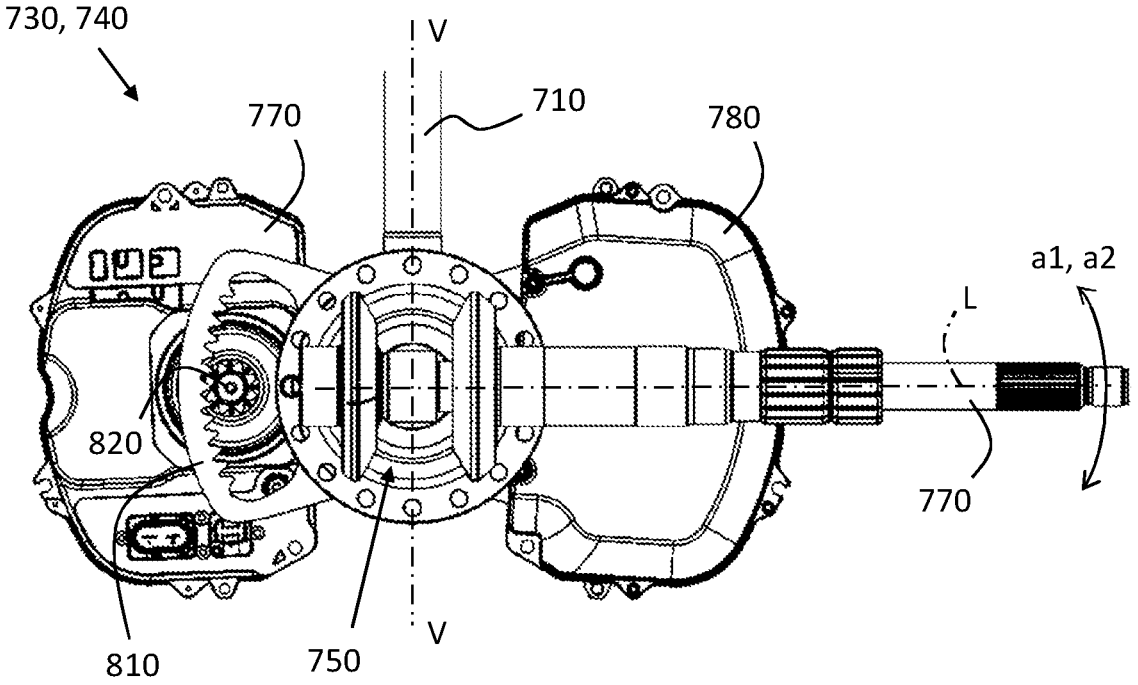
Figure 9:
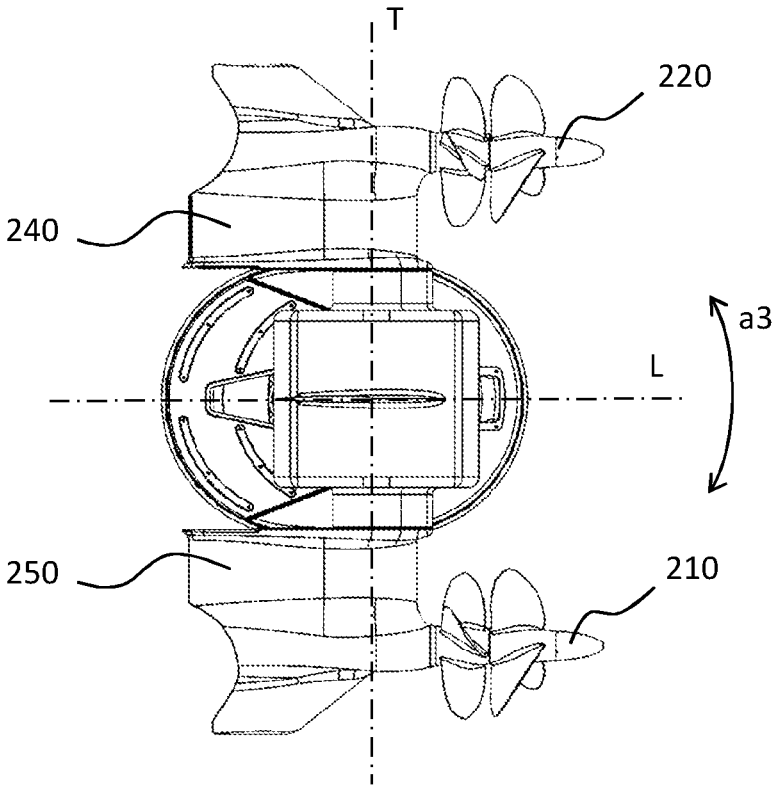
Figure 10:
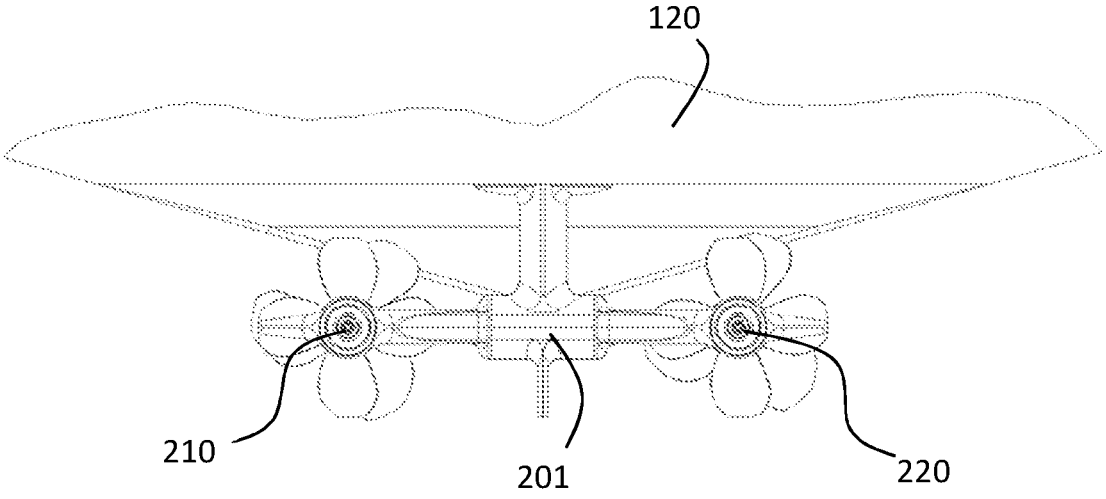
FIG. 10 illustrates another example drive unit.

FIGS. 7, 8, and 9 illustrate an in-board example where a power source is located above the drive unit and where power from the power source is guided into the drive unit via a vertical drive shaft 710. The vertical drive shaft 710 extends along the vertical axis V down to a central bevel gear 720, where first and second lateral drive shafts 730, 740 extend out along the lateral axis T from the central bevel gear to the first and second propulsion units 210, 220. Respective outer bevel gear arrangements 750, 760 connect the lateral drive shafts 730, 740 to propeller axles 790, 795 of the first and second propulsion units 210, 220. In this example there are two counter-rotating propellers per propulsion unit.

Each propulsion unit 210, 220 may comprise an electric or hydraulic elevation motor 770, 780 connected to a rack and pinion arrangement 810, 820 arranged to control a rotation of the propulsion unit 210, 220 about the lateral axis T, as illustrated in FIG. 8. Thus, the elevation angle of each propulsion unit 210, 220 can be controlled by actuation of the elevation motor 770, 780. The rack 810 may be curved as illustrated in FIG. 8, or replaced by a ring gear if it is desired to rotate the propulsion unit freely about the lateral axis T.

The drive unit 110, 200, 300 optionally comprises a main exhaust channel extending from an input aperture 235 formed in the hull interface 230 to a branching point intersected by the base plane, where first and second exhaust channel branches extend from the branching point to output apertures 236, 237 formed in the first propulsion unit 210 and in the second propulsion unit 220, respectively. The exhaust channel can be used with advantage to transport exhaust from a combustion engine away from the vessel.

As mentioned above the drive units discussed herein provide several force generating options which can be used to control motion by the vessel 100. The motion control of the vessel optionally comprises any of trim angle, roll mitigation, longitudinal thrust control and lateral thrust control.

The different options of generating force by the drive units discussed herein can be exploited by the control unit 130 in different ways. One straight forward option to control motion by the vessel 100 is simply to allow an operator to control elevation angle of the two propulsion units 210, 220 separately, along with the joint azimuth angle control, using some form of manual control input means like levers or joysticks. The operator may then obtain a desired motion by the vessel by manual control of the drive unit. This type of manual control may however, be difficult to learn properly, and may require an experienced operator.

The control of the drive unit may also be performed in a semi-automated manner. In this case the operator may be given control of pitch angle, roll angle, and thrust. The three control inputs can be translated using, e.g., predetermined look-up tables accessible from the control unit. Thus, as a control input from an operator is received, the control unit 130 is able to translate the input command into corresponding elevation angles of the propulsion units and azimuth angle of the drive unit. A feedback system may be implemented based on input data from one or more sensor systems, allowing the control unit 130 to dynamically adjust azimuth angle and elevation angles to maintain a configured pitch or roll angle. The look-up tables and control functions can be determined based on a combination of practical experimentation, computer simulation, and mathematical analysis.

Machine learning may also be used with advantage to control the drive units disclosed herein, and in particular the different degrees of freedom available in the drive unit, that is, the elevation angles of the two propulsion units, the thrust power of the different propulsion units, and the azimuth angle of the drive unit.

Machine learning can be used to mitigate undesired roll and pitch motion by a vessel. In this case the control unit 130 measures a current motion by the vessel 100 using one or more of the sensor systems 140, 150, 160 discussed above, preferably at least the IMU 160. The control unit 130 implements a machine learning structure, such as a neural network or other machine learning structure. The inputs to the machine learning structure are the sensor system signals, i.e., the input signals from one or more of an IMU, a vision-based sensor, a radar-based sensor, a lidar-based sensor and/or a satellite-based positioning system sensor. The outputs from the machine learning structure are the azimuth angle configuration of the drive unit, the elevation angles of the propulsion units, and the level of thrust applied at each propulsion unit. The machine learning structure may be trained a-priori to mitigate undesired roll and pitch motion by a vessel using a computer implemented model of a given vessel, and also on-line by feedback from different sensor systems. The control unit 130 may for instance implement a roll stabilization system using machine learning by feeding back measured roll motion to the machine learning structure and training the machine learning structure to minimize roll motion by the vessel. The machine learning structure can be trained using real world data obtained from a vessel in use, comprising current motion data of the vessel captured by one or more sensor systems, such as one or more IMUs, compasses, GPS systems, and STW meters. The training data can also comprise manual control input from an experienced boat operator. The machine learning structure can also be trained using a feedback mechanism, where motion data by the vessel is obtained and where the machine learning structure is trained to reduce a difference between the captured motion data and a desired motion by the boat, such as a reduced roll motion, or a desired trim angle. Synthetic data can also be used to train the machine learning structure. In this case a computer-implemented simulator is set up to model motion behavior by the vessel 100 in different conditions, and the machine learning structure can then be trained to reduce a difference between current vessel behavior in different conditions (sea, wind, waves, etc.) and a desired vessel behavior. A weighted objective function may be used to train the machine learning structure, where some forms of motion are given priority over other types of motion. Roll motion may e.g., be given preference over trim angle and yaw motion.

It is also possible to train different machine learning structures with different objective functions. One machine learning structure may e.g., be trained to primarily reduce roll motion, while another may be trained to primarily optimize energy consumption of the vessel. A third machine learning structure may be trained to provide a responsive control of the vessel 100, i.e., a maneuverable vessel which responds quickly to operator control inputs. An operator of the vessel may then be able to select a current machine learning structure in dependence of a desired vessel behavior.

Various applications can be realized using the combination of the control unit 130 and one or more drive units according to the discussion above. In most cases, the vessel 100 comprises a control unit 130 arranged to obtain a current motion of the vessel 100 and a desired motion of the vessel 100. The control unit 130 is arranged to adjust the rotation a3 of the drive unit about the vertical axis V and/or the rotations of the propulsion units 210, 220 about the lateral axis a1, a2 to reduce a difference between the current motion of the vessel 100 and the desired motion of the vessel 100.

According to an example, the current and desired motion of the vessel 100 are defined relative to ground (sea bottom), and the desired motion corresponds to stationarity by the vessel 100. The control unit 130 is in this case arranged to adjust at least the rotation a3 about the vertical axis V to keep the vessel stationary relative to ground. This can be implemented using machine learning as discussed above, in which case a machine learning structure is defined that takes sensor input signals indicative of vessel position as input and gives control signals for azimuth angle, elevation angles, and propulsion unit thrust as output. The machine learning structure can be trained off-line using a computer-implemented model of the vessel, and also on-line using feedback from, e.g., a positioning system that indicates the differences between a desired location of the vessel and a current location of the vessel. The function can also be implemented using more traditional feedback-based control systems, where a current position of the vessel in relation to a desired position of the vessel is used to determine a suitable setting of the drive unit azimuth angle, elevation angles, and propulsion unit thrust to reduce the position error of the vessel.

According to another example, the current and desired motion of the vessel 100 comprise roll angle and/or roll motion of the vessel. The control unit 130 is then arranged to adjust the respective rotations a1, a2 of the propulsion units 210, 220 about the lateral axis T to set a desired roll angle by the vessel and/or to reduce a roll motion by the vessel. An implementation example of this function will be discussed below in connection to FIG. 12. The function may also be implemented using machine learning techniques, where a machine learning structure is trained either off-line and/or on-line using feedback of roll motion by the vessel.

According to yet another example, the current and desired motion of the vessel 100 comprise pitch angle and/or pitch motion by the vessel, and the control unit 130 is arranged to adjust the respective rotations a1, a2 of the propulsion units 210, 220 about the lateral axis T to set a desired pitch angle by the vessel and/or to reduce a pitch motion of the vessel 100.

Figure 12:
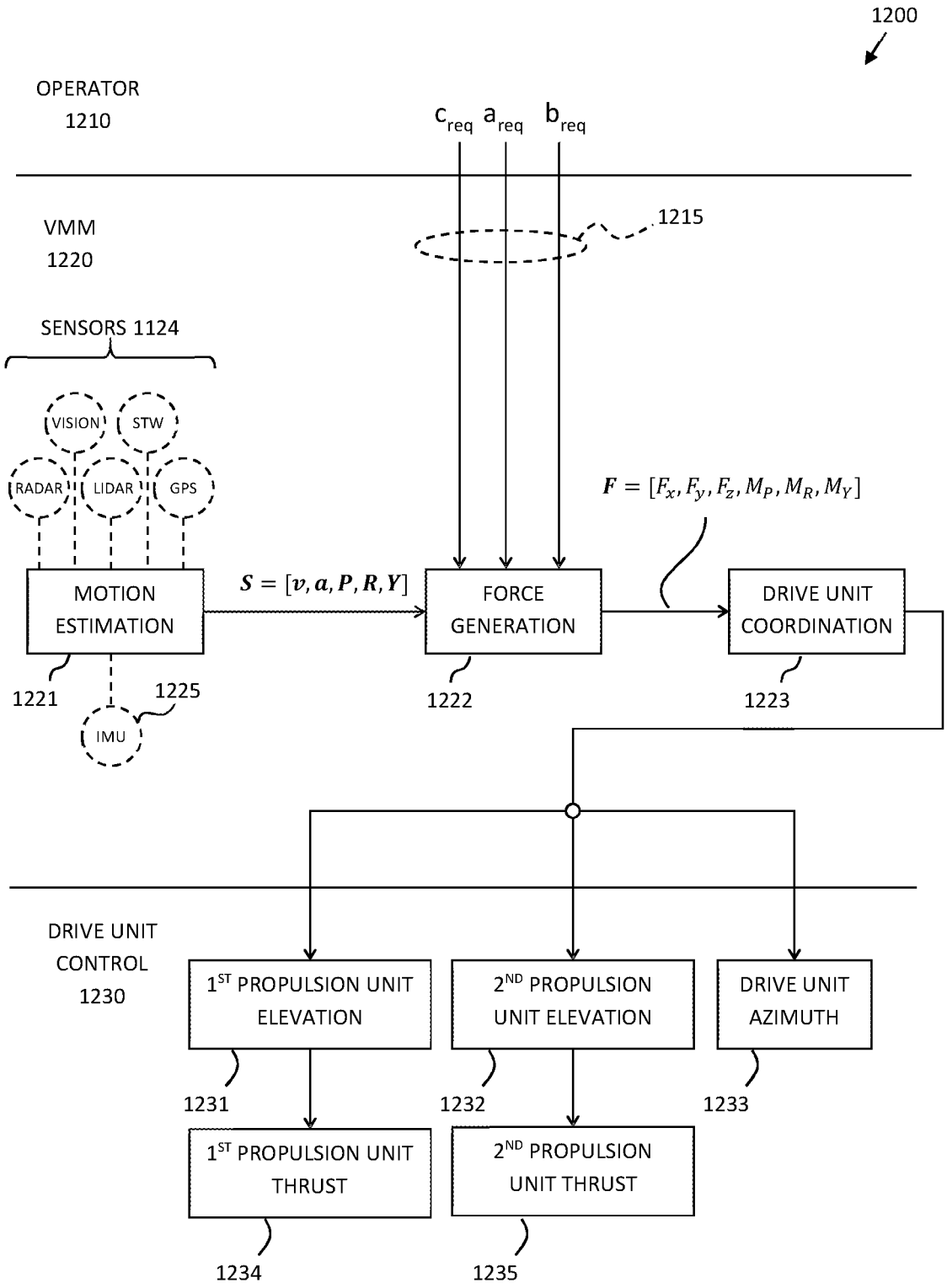
FIG. 12 illustrates an example control architecture for a drive unit.

FIG. 12 illustrates an example control function architecture 1200 for control of one or more drive units according to the discussion above. In this example architecture, the operator function 1210 generates vessel motion requests 1215, which may comprise a desired steering angle or an equivalent curvature $c_{req}$ to be followed by the vessel, and which may also comprise a desired vessel acceleration $a_{req}$ and also other types of vessel motion requests, which together describe a desired motion by the vessel along a desired path at a desired velocity profile along with one or more constraints, such as reduced roll motion, and/or reduced pitch motion by the vessel. The vessel motion requests 1215 may also be an instruction to maintain the vessel position at some target location and/or facing in a given direction. The operator function 1210 may also be configured to generate a behavior request $a_{req}$. This request may be indicative of a desired behavior by the vessel, such as if a reduced roll motion is desired, a reduced energy consumption, a reduced pitch or optimized trim angle, and so on. These parameters may be provided by an operator of the vessel, or by a passenger in the vessel.

It is understood that the motion requests can be used as base for determining or predicting a required amount of longitudinal and lateral forces to be generated by the drive unit, and also roll moments and pitch moments which needs to be generated by the vessel 100 in order to successfully complete a desired maneuver. The operator function 1210 can of course also be replaced by manual input signals, from a steering wheel and thrust control, for example.

The vessel motion management (VMM) system 1220 implemented by the control unit 130 performs vessel state and motion estimation, by a motion estimation function 1221. In this manner the VMM system continuously determines a vessel state S comprising, e.g., velocities v in three dimensions ($[v_x, v_y, v_z]$), accelerations a in three dimensions ($[a_x, a_y, a_z]$), and also pitch P, roll R and yaw motion Y (as indicated in FIG. 1), using various sensors 1124 arranged on the vessel, where at least one or more IMU sensors 1225 are preferred. The pitch, roll and yaw motions may be determined as absolute angles and as time derivatives of the angles.

The result of the motion estimation 1221, i.e., the estimated vessel state S describing the current motion of the vessel 100 and potentially also the predicted future motion of the vessel in response to a requested actuation by the drive unit or drive units is input to the master VMM force generation module 1222 which determines the required global forces and moments F for the different drive units on the vessel to cause the vessel 100 to move according to the requested acceleration and curvature profiles $a_{req}$, $c_{req}$, and to generally behave according to the desired motion request 1215. The forces involved may be longitudinal forces $F_x$, lateral forces $F_y$, lifting or counter-lifting forces $F_z$, pitch moment $M_P$, roll moment $M_R$, and yaw moments $M_Y$. The determination of the global force vector may be achieved using look-up tables, using analytic functions (based on motion models and/or physical principles such as Newtons law), by on-line computer simulation, and/or using machine learning structures which have been trained off-line based on computer-implemented behavioral models of the vessel 100. The required global force vector F is input to a drive unit coordination function 1223 which allocates forces and coordinates the control degrees of freedom of the drive units on the vessel, i.e., sets the elevation angles and the azimuth angles of the different drive units, and also the propulsion thrust of each propulsion unit. The global force vector may comprise forces in three dimensions, i.e., longitudinal forces $F_x$, lateral forces $F_y$, and lifting or counter-lifting forces $F_z$, as well as pitch moment $M_P$, roll moment $M_R$, and yaw moments $M_Y$, i.e., $F=[F_x, F_y, F_z, M_P, M_R, M_Y]$.

The drive unit coordination function 1223 may be based on a straight forward look-up table which maps required forces to drive unit settings, or on an analytic function which maps required forces to drive unit settings, or on an optimization routine which finds the optimal drive unit settings for generating a given set of required forces, e.g., based on an energy cost function or the like. According to some aspects, the interface to the drive unit controller also comprises a return channel where the drive unit controllers can feedback capability information to the central controller, which enables the central VMM controller to impose constraints on the actuation at the different drive units. The aggregated drive unit coordination function outputs a control allocation for at least some of the drive units on the vessel. This allocation is received by drive unit controllers 1230, which control the different parameters of the drive units, i.e., the elevation angles 1231, 1232, and the azimuth angle 1233, along with the propulsion unit thrusts 1234, 1235.

To summarize, FIG. 12 illustrates a control architecture which can be used to control one or more drive units according to the present teaching. Control of a drive unit comprises configuration of azimuth angle, propulsion unit elevation angles, and thrust power for each propulsion unit (if they are separately controllable as is the case if electric machines are used as power source). The system obtains a desired motion by the vessel, which may comprise an acceleration or speed through water, and also a desired steering. The desired motion may also comprise aspects such as roll stabilization, trim setting, and so on. The system 1200 then uses one or more sensor systems 1124 (preferably comprising at least one IMU 1225) to determine a current motion by the vessel, which may also involve predicting a future motion by the vessel based on a current motion and on a current control input to the drive unit or drive units on the vessel. This motion estimate is used in a force generation module which determines the required forces in order for the current motion by the vessel to be changed into a desired motion by the vessel. The forces involved may be longitudinal forces $F_x$, lateral forces $F_y$, lifting or counter-lifting forces $F_z$, pitch moment $M_P$, roll moment $M_R$, and yaw moments $M_Y$. The forces required to alter the behavior of the vessel to be more like the desired motion behavior 1215 is then fed to a drive unit coordination module 1223 which determines the drive unit settings that generate the required forces, e.g., by executing a computer-implemented optimization routine.

Figure 13:
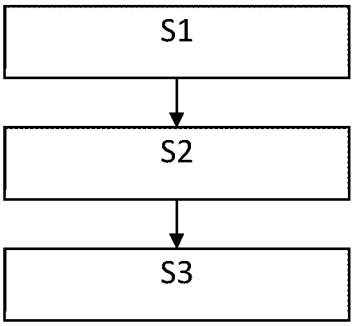
FIG. 13 is a flow chart illustrating methods.

FIG. 13 is a flow chart illustrating methods which summarizes at least some of the discussion above. There is illustrated a method for controlling propulsion and trim of a marine vessel 100. The method comprises configuring S1 a drive unit 110, 200, 300 to extend out from the vessel 100 along a vertical axis V to a base plane normal to the vertical axis V, where the base plane is spanned by orthogonal longitudinal and lateral axes L, T. The method also comprises configuring S2 a first propulsion unit 210 and a second propulsion unit 220 arranged separated along the lateral axis T and intersected by the base plane, where the first propulsion unit 210 and the second propulsion unit 220 are jointly rotatable a3 about the vertical axis V, where the first propulsion unit 210 and the second propulsion unit 220 are individually rotatable a1, a2 about the lateral axis T, and controlling S3 propulsion and trim of the marine vessel 100 by controlling joint rotation of the propulsion units 210, 220 about the vertical axis V and separate rotations of the propulsion units 210, 220 about the lateral axis T.

Figure 14:
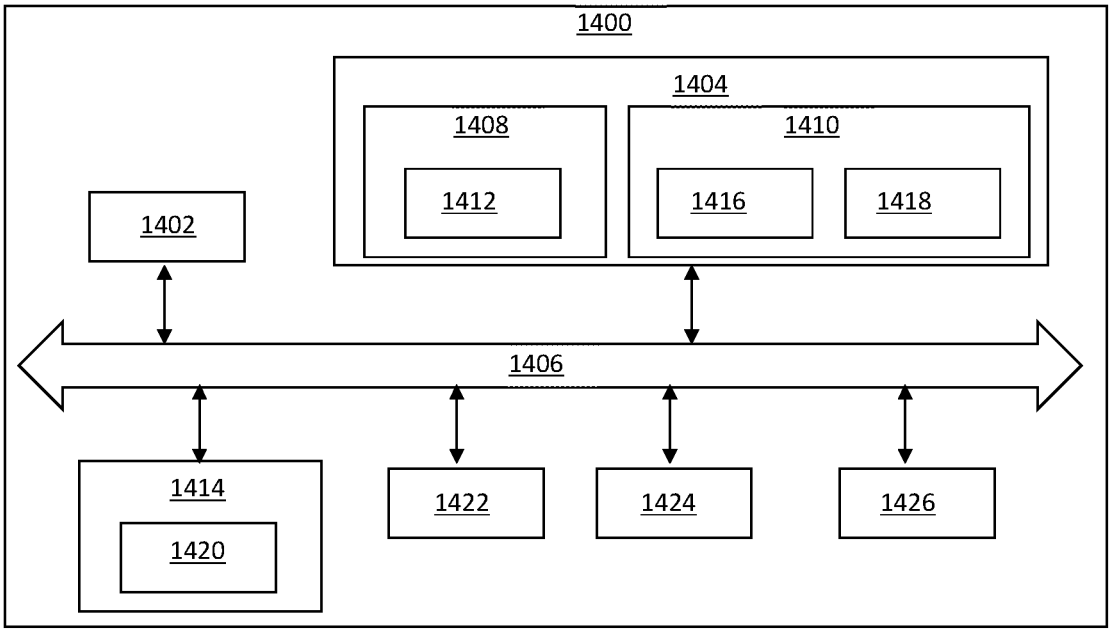
FIG. 14 is a schematic diagram of an exemplary computer system.

FIG. 14 is a schematic diagram of a computer system 1400 for implementing examples disclosed herein. The computer system 1400 is adapted to execute instructions from a computer-readable medium to perform these and/or any of the functions or processing described herein. The computer system 1400 may be connected (e.g., networked) to other machines in a LAN, an intranet, an extranet, or the Internet. While only a single device is illustrated, the computer system 1400 may include any collection of devices that individually or jointly execute a set (or multiple sets) of instructions to perform any one or more of the methodologies discussed herein. Accordingly, any reference in the disclosure and/or claims to a computer system, computing system, computer device, computing device, control system, control unit, electronic control unit (ECU), processor device, etc., includes reference to one or more such devices to individually or jointly execute a set (or multiple sets) of instructions to perform any one or more of the methodologies discussed herein. For example, control system may include a single control unit, or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 1400 may comprise at least one computing device or electronic device capable of including firmware, hardware, and/or executing software instructions to implement the functionality described herein. The computer system 1400 may include a processor device 1402 (may also be referred to as a control unit), a memory 1404, and a system bus 1406. The computer system 1400 may include at least one computing device having the processor device 1402. The system bus 1406 provides an interface for system components including, but not limited to, the memory 1404 and the processor device 1402. The processor device 1402 may include any number of hardware components for conducting data or signal processing or for executing computer code stored in memory 1404. The processor device 1402 (e.g., control unit) may for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processor device may further include computer executable code that controls operation of the programmable device.

The system bus 1406 may be any of several types of bus structures that may further interconnect to a memory bus (with or without a memory controller), a peripheral bus, and/or a local bus using any of a variety of bus architectures. The memory 1404 may be one or more devices for storing data and/or computer code for completing or facilitating methods described herein. The memory 1404 may include database components, object code components, script components, or other types of information structure for supporting the various activities herein. Any distributed or local memory device may be utilized with the systems and methods of this description. The memory 1404 may be communicably connected to the processor device 1402 (e.g., via a circuit or any other wired, wireless, or network connection) and may include computer code for executing one or more processes described herein. The memory 1404 may include non-volatile memory 1408 (e.g., read-only memory (ROM), erasable programmable read-only memory (EPROM), electrically erasable programmable read-only memory (EEPROM), etc.), and volatile memory 1410 (e.g., random-access memory (RAM)), or any other medium which can be used to carry or store desired program code in the form of machine-executable instructions or data structures, and which can be accessed by a computer or other machine with a processor device 1402. A basic input/output system (BIOS) 1412 may be stored in the non-volatile memory 1408 and can include the basic routines that help to transfer information between elements within the computer system 1400.

The computer system 1400 may further include or be coupled to a non-transitory computer-readable storage medium such as the storage device 1414, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 1414 and other drives associated with computer-readable media and computer-usable media may provide non-volatile storage of data, data structures, computer-executable instructions, and the like.

A number of modules can be implemented as software and/or hard coded in circuitry to implement the functionality described herein in whole or in part. The modules may be stored in the storage device 1414 and/or in the volatile memory 1410, which may include an operating system 1416 and/or one or more program modules 1418. All or a portion of the examples disclosed herein may be implemented as a computer program product 1420 stored on a transitory or non-transitory computer-usable or computer-readable storage medium (e.g., single medium or multiple media), such as the storage device 1414, which includes complex programming instructions (e.g., complex computer-readable program code) to cause the processor device 1402 to carry out the steps described herein. Thus, the computer-readable program code can comprise software instructions for implementing the functionality of the examples described herein when executed by the processor device 1402. The processor device 1402 may serve as a controller or control system for the computer system 1400 that is to implement the functionality described herein.

The computer system 1400 also may include an input device interface 1422 (e.g., input device interface and/or output device interface). The input device interface 1422 may be configured to receive input and selections to be communicated to the computer system 1400 when executing instructions, such as from a keyboard, mouse, touch-sensitive surface, etc. Such input devices may be connected to the processor device 1402 through the input device interface 1422 coupled to the system bus 1406 but can be connected through other interfaces such as a parallel port, an Institute of Electrical and Electronic Engineers (IEEE) 1394 serial port, a Universal Serial Bus (USB) port, an IR interface, and the like. The computer system 1400 may include an output device interface 1424 configured to forward output, such as to a display, a video display unit (e.g., a liquid crystal display (LCD) or a cathode ray tube (CRT)). The computer system 1400 may also include a communications interface 1426 suitable for communicating with a network as appropriate or desired.

The operational steps described in any of the exemplary aspects herein are described to provide examples and discussion. The steps may be performed by hardware components, may be embodied in machine-executable instructions to cause a processor to perform the steps, or may be performed by a combination of hardware and software. Although a specific order of method steps may be shown or described, the order of the steps may differ. In addition, two or more steps may be performed concurrently or with partial concurrence.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the inventive concepts being set forth in the following claims.

The invention claimed is:

1. A drive unit for propulsion and trim control of a vessel, the drive unit extending in use from the vessel along a vertical axis to a base plane normal to the vertical axis, and spanned by orthogonal longitudinal and lateral axes, the drive unit comprising a first propulsion unit and a second propulsion unit arranged separated along the lateral axis and intersected by the base plane, where the first propulsion unit and the second propulsion unit are jointly rotatable about the vertical axis, where the first propulsion unit and the second propulsion unit are individually rotatable about the lateral axis, and where the first propulsion unit and the second propulsion unit each comprise an electric or hydraulic elevation motor arranged to control a rotation of the first propulsion unit and a rotation of the second propulsion unit, respectively, about the lateral axis.

2. The drive unit according to claim 1, comprising a hull mount interface intersected by the vertical axis.

3. The drive unit according to claim 1, where the first propulsion unit and the second propulsion unit are jointly rotatable about the vertical axis over at least 360 degrees.

4. The drive unit according to claim 1, where the first propulsion unit and the second propulsion unit are individually rotatable about the lateral axis over at least 270 degrees.

5. The drive unit according to claim 1, where the first and the second propulsion unit comprise respective oblate foiling plane members, where the rotation of the first propulsion unit and/or the second propulsion unit about the lateral axis determines an angle between the oblate foiling plane member of the propulsion unit and the base plane of the drive unit.

6. The drive unit according to claim 1, where the first and second propulsion units comprise respective single propeller propulsors, or dual propeller propulsors.

7. The drive unit according to claim 1, where each propulsion unit comprises an electric or hydraulic elevation motor connected to a rack and pinion arrangement arranged to control the rotation of the first propulsion unit and/or the second propulsion unit about the lateral axis.

8. The drive unit according to claim 1, comprising a main exhaust channel extending from an input aperture formed in a hull interface to a branching point intersected by the base plane, where the first and the second exhaust channel branches extend from the branching point to output apertures formed in the first propulsion unit and in the second propulsion unit, respectively.

9. The drive unit according to claim 1, comprising a vertical drive shaft extending along the vertical axis down to a central bevel gear, a first lateral drive shaft and a second lateral drive shaft extending out from the central bevel gear along the lateral axis to the first and second propulsion units, respectively, and a first outer bevel gear arrangement connects the first lateral drive shaft to a propeller axle of the first propulsion unit, and a second outer bevel gear arrangement connects the second lateral drive shaft to a propeller axle of the second propulsion unit.

10. The drive unit according to claim 1, where the first and the second propulsion units comprise submerged electric propulsion machines arranged to power respective propulsors of the propulsion units.

11. The drive unit according to claim 10, where each electric propulsion machine is formed around a hollow stator, where a water channel is formed through the hollow stator in direction of the longitudinal axis.

12. The drive unit according to claim 10, where the first and the second propulsion unit each comprise two electric propulsion machines, separated along the longitudinal axis, where each electric propulsion machine is arranged to power a respective propeller.

13. The drive unit according to claim 1, comprising a control unit arranged to obtain a current motion of the vessel and a desired motion of the vessel, where the control unit is arranged to adjust a rotation of the drive unit about the vertical axis and/or the rotation of the first propulsion unit and/or the second propulsion unit about the lateral axis to reduce a difference between the current motion of the vessel and the desired motion of the vessel.

14. The drive unit according to claim 13, where the current and desired motion of the vessel are defined relative to ground, and the desired motion corresponds to stationarity by the vessel, where the control unit is arranged to adjust at least the rotation of the drive unit about the vertical axis to keep the vessel stationary relative to ground.

15. The drive unit according to claim 13, where the current and desired motion of the vessel comprise roll angle and/or roll motion of the vessel, where the control unit is arranged to adjust the rotation of the first propulsion unit and/or the second propulsion unit about the lateral axis to set a desired roll angle by the vessel and/or to reduce a roll motion by the vessel.

16. The drive unit according to claim 13, where the current and desired motion of the vessel comprise pitch angle and/or pitch motion by the vessel, where the control unit is arranged to adjust the rotation of the first propulsion unit and/or the second propulsion unit about the lateral axis to set a desired pitch angle by the vessel and/or to reduce a pitch motion of the vessel.

17. A marine vessel comprising the drive unit according to claim 1.

18. A method for controlling propulsion and trim of a vessel, comprising configuring a drive unit to extend out from the vessel along a vertical axis to a base plane normal to the vertical axis, where the base plane is spanned by orthogonal longitudinal and lateral axes, configuring a first propulsion unit and a second propulsion unit arranged separated along the lateral axis and intersected by the base plane, where the first propulsion unit and the second propulsion unit are jointly rotatable about the vertical axis, where the first propulsion unit and the second propulsion unit are individually rotatable about the lateral axis, where the first propulsion unit and the second propulsion unit each comprises an electric or hydraulic elevation motor arranged to control a rotation of the propulsion unit about the lateral axis, and controlling propulsion and trim of the vessel by controlling joint rotation of the propulsion units about the vertical axis and separate rotations of the first propulsion unit and the second propulsion unit about the lateral axis.

19. The drive unit according to claim 1, where the first propulsion unit and the second propulsion unit are individually rotatable about the lateral axis by at least 360 degrees.

* * * * *